US006287094B1

(12) United States Patent
Bleitz et al.

(10) Patent No.: US 6,287,094 B1
(45) Date of Patent: Sep. 11, 2001

(54) INLET TUBE DIFFUSER ELEMENT FOR A HYDRAULIC PUMP

(75) Inventors: Daniel J. Bleitz, Wixom; Leonard Frank Bishop, Sterling Heights; James Asam, Allen Park, all of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/383,843

(22) Filed: Aug. 26, 1999

(51) Int. Cl.[7] ..... F04B 23/00
(52) U.S. Cl. ..... 417/440
(58) Field of Search ..... 417/440, 439, 417/441, 300, 299, 310, 307

(56) References Cited

U.S. PATENT DOCUMENTS 4,505,649 3/1985 Masuda et al. .
4,526,524 7/1985 Kondo et al. .
4,691,619 * 9/1987 Kervagoret ..... 91/459
4,714,413 * 12/1987 Duffy ..... 417/293
5,111,660 * 5/1992 Gettel ..... 60/468
5,161,959 11/1992 Gettel .
5,201,878 4/1993 Abe et al. .
5,893,589 4/1999 Bleitz et al. .

FOREIGN PATENT DOCUMENTS 2168759 6/1986 (GB) .

* cited by examiner

*Primary Examiner*—Teresa Walberg
*Assistant Examiner*—Thor Campbell
(74) *Attorney, Agent, or Firm*—Gregory P. Brown

(57) ABSTRACT

A hydraulic fluid pump (10), including a housing (12), a pumping apparatus (14), an inlet (16), a pressure chamber (17), an outlet (18), a bypass valve (20) and a diffuser (24). Wherein cavitation is reduced by using the diffuser (24) to supercharge fluid from the outlet (18) to increase the static pressure of the fluid entering the pumping apparatus (14). And wherein the inlet (16) and the diffuser (24) are designed to minimize the complexity, cost and packaging considerations of the hydraulic fluid pump (10).

10 Claims, 2 Drawing Sheets

INLET TUBE DIFFUSER ELEMENT FOR A HYDRAULIC PUMP

TECHNICAL FIELD

The present invention relates generally to hydraulic pumps and more particularly to improvements to such pumps so that cavitation, production costs, pump weight and packaging considerations are minimized.

BACKGROUND ART

Conventional automotive power steering systems utilize a pump to provide hydraulic fluid to the power steering gear. These pumps are commonly driven by a belt system attached to the engine which varies the pump speed according to engine RPM. These pumps are preferably designed to provide a consistent flow rate of hydraulic fluid to the power steering system independent of the pump speed. The consistent output flow rate when paired with the variable pump speed can lead to large pressure differentials between the pump inlet and outlet. These large pressure differentials are common at high engine and pump RPM. These pressure differentials may result in cavitation within the pumping chamber. Cavitation can cause undesirable high frequency noise and can lead to premature failure of the pump.

A known technique for minimizing cavitation and ensuring consistent flow output is through the use of a bypass valve and a diffuser. The bypass valve channels variable amounts of fluid from the pump outlet back into the pump inlet allowing the pump to produce a constant fluid output flow at variable pump speeds. The diffuser is used to take fluid from the bypass valve, use this fluid to supercharge low pressure fluid in a reservoir, and draw the fluid from the reservoir into the pump raising the static pressure at the pump inlet. Raising the static pressure at the pump inlet reduces cavitation and its undesirable characteristics.

One known technique for raising the static pressure at the pump inlet using a bypass valve and diffuser comprises using the high pressure outlet fluid from the bypass valve and passing it through a diffuser. In this technique, the bypass valve controls the amount of fluid passing through it to produce a consistent fluid output flow from the pump at varying pump RPM. As fluid passes through the bypass valve, fluid is allowed to flow into a diffuser. As the fluid enters the diffuser, it mixes with the fluid contained in a reservoir located at the mouth of the diffuser. The combined fluid passes through the diffuser which transfers the kinetic energy of the fluid into static pressure.

The diffuser, in this known technique, transfers the kinetic energy of the fluid into static pressure by passing the fluid through the throat of the diffuser which increases the fluid velocity, and therefore the kinetic energy. This is due to the reduction in cross-sectional area along the length of the diffuser throat. After passing through the throat of the diffuser, the fluid passes through a length of the diffuser with an expanding cross-section. The expansion of cross-section causes a decrease in velocity and kinetic energy by transferring them into static pressure. Finally, the fluid, with increased static pressure, flows into a contoured plug formed to direct the fluid in the direction of the inlet port.

This known technique is effective in reducing cavitation in hydraulic pumps. It does, however, increase the complexity and cost of manufacturing the pump, requires the machining of additional parts and enlarges the pump profile. The diffuser and contoured plug are manufactured as separate parts. The diffuser and contoured plug are typically formed of high strength materials such as metal to permit proper sealing with the pump housing. Also, the inlet must typically be located on the top of the pump to allow room for the bypass and diffuser chambers. Therefore, there is a need for a design that retains the reduction in cavitation accomplished by the bypass-diffuser methods, while reducing the complexity, cost, number of parts, machining requirements, weight and profile of the pump.

SUMMARY OF THE INVENTION

It is therefore an object of the present invention to provide a hydraulic pump that retains the known benefits of the bypass-diffuser method in reducing cavitation while further reducing the complexity, cost, number of parts, machining requirements, weight and profile of the pump.

In accordance with the objects of this invention, a hydraulic pump is provided. The hydraulic pump includes a housing defining a cylindrical space containing a pumping apparatus. The pump contains a fluid inlet allowing fluid to enter the pump and a fluid outlet allowing expulsion of fluid therefrom. As the fluid passes through the inlet, it flows into a pressure chamber and then into the pumping apparatus. The pumping apparatus conveys the fluid toward the pump outlet.

The pump contains a flow control bypass valve. The flow control bypass valve allows portions of the fluid passing to the outlet to be routed back towards the pressure chamber such that flow through the pump outlet is constant at varying pump speeds. The fluid flows through a diffuser as it moves from the bypass valve to the pressure chamber. The diffuser's cross-section decreases along the path of fluid flow.

The decreasing cross-section of the diffuser increases the kinetic energy of the fluid. As the fluid enters the pressure chamber this kinetic energy is converted to static pressure. The fluid from the diffuser mixes with the fluid from the fluid inlet in the pressure chamber and provides an increased static pressure fluid to the pumping apparatus. The increased static pressure of fluid entering the pumping apparatus reduces cavitation at high pump RPM.

Other objects and features of the present invention will become apparent when viewed in light of the detailed description of the preferred embodiment when taken in conjunction with the attached drawings and appended claims.

DESCRIPTION OF THE PREFERRED EMBODIMENT(S)

Figure 1:
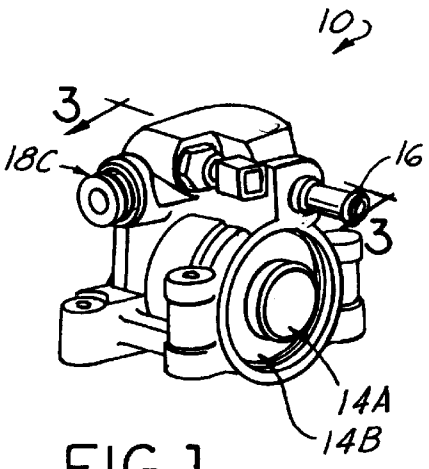
FIG. 1 is a schematic view of one preferred embodiment of a hydraulic fluid pump in accordance with the present invention.

Referring now to FIG. 1, which is a schematic view of a hydraulic fluid pump 10 in accordance with the present invention. The disclosed hydraulic fluid pump 10 is preferably for use in automotive power steering applications. However, the disclosed hydraulic fluid pump may be used in a variety of applications, including non-automotive applications.

Figure 2:
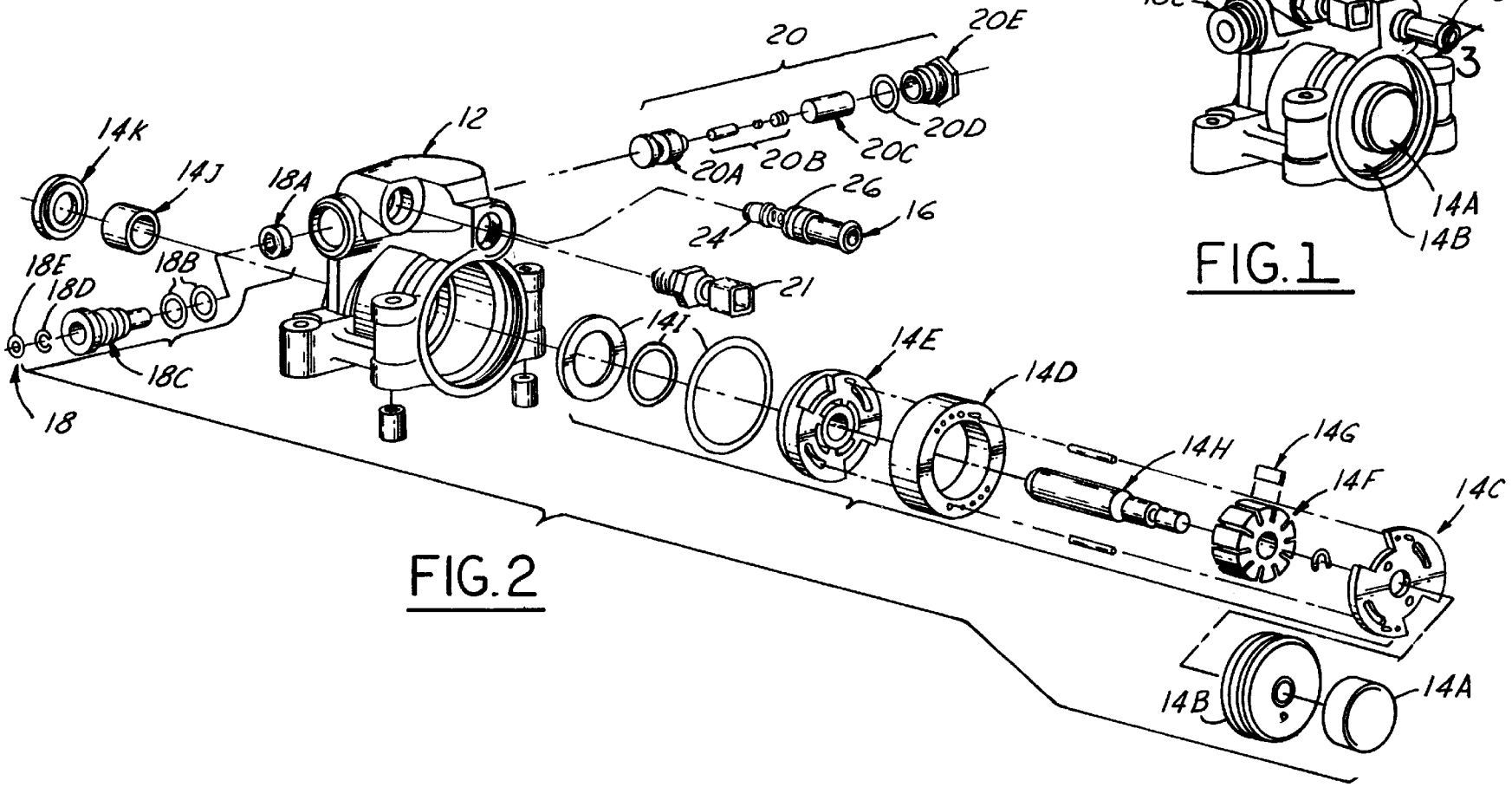
FIG. 2 is an exploded schematic view of a preferred embodiment of a hydraulic fluid pump in accordance with the present invention.

Referring now to FIG. 2, which is an exploded schematic view of the hydraulic pump 10 in accordance with the present invention. The hydraulic fluid pump 10 includes a housing 12 defining a cylindrical space containing a pumping apparatus 14. The hydraulic fluid pump 10 contains a fluid inlet 16 allowing fluid to enter a pressure chamber 17 (best seen in FIG. 3) which feeds the pumping apparatus 14. The pumping apparatus 14 pumps the fluid towards the fluid outlet 18. The fluid outlet 18 is comprised of a discharge port orifice 18A, two seals 18B, a connector 18C, a retaining ring 18D and an O-ring seal 18E.

The pumping apparatus 14 consists of a pump cover 14A, a top bushing 14B, an upper pressure plate 14C, a cam section 14D, and a lower pressure plate 14E. While the pump cover 14A and the top bushing 14B are illustrated as two separate parts, they may also be formed integrally. The cam section 14D houses a vane rotor 14F. The vane rotor contains vanes 14G positioned radially around its circumference. The vane rotor 14F is driven by a shaft 14H. As the shaft 14H rotates, the vane rotor 14F is rotated within the cam section 14D. The vanes 14G move radially in and out of the vane rotor 14F to stay in contact with the walls of the cam section 14D. In this fashion, fluid is pulled into the pumping apparatus 14 as the area between the vanes 14G expands and is forced out of the pumping apparatus 14 as the area between the vanes 14G compresses. Sealing rings 14I are used to seat the pumping apparatus 14 within the housing 12. The shaft 14H is supported rotatably in a bushing 14J, which is supported on the housing 12. A shaft seal 14K prevents flow of hydraulic fluid from the pumping chambers.

The hydraulic fluid pump 10 contains a bypass valve 20. The bypass valve 20 allows portions of the fluid passing to the fluid outlet 18 to be routed back towards the fluid inlet 16 such that the hydraulic fluid pump 10 output is constant at varying pump speeds. The bypass valve 20 is comprised of a relief valve spool 20A, a coiled compression spring, a ball, a ball seat 20B, and a larger compression spring 20C that urges the relief valve spool 20A toward a high speed position where the bypass valve 20 is open. A seal 20D and a plug 20E close the adjacent end of the bore mechanically and hydraulically.

An actuator assembly 21 for an electronically variable orifice is used to vary pump output based upon an output signal produced by a microprocessor accessible to control algorithms and input signals produced by speed sensors, which produce signals representing the speed of the vehicle and steering wheel.

Figure 3:
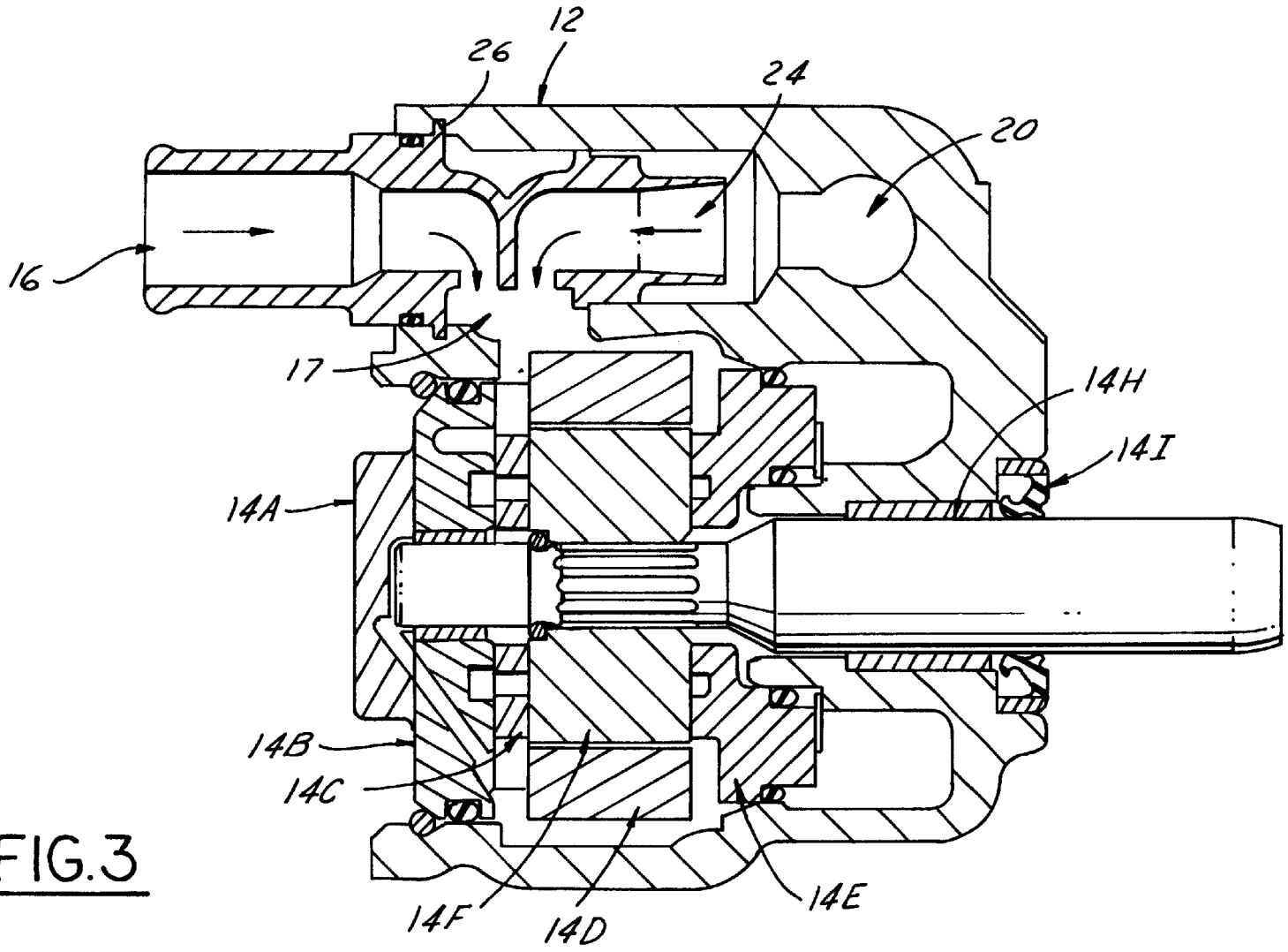
FIG. 3 is a /cross-sectional view of the hydraulic fluid pump illustrated in /FIG. 1, the cross-section being taken along the line 3—3 in FIG. 1 and in the direction of the arrows.

Referring now to FIG. 3, which is a cross-sectional view of a hydraulic fluid pump 10 in accordance with the present invention. The fluid flowing through the bypass valve 20 is passed into a diffuser 24. The diffuser 24 transfers the kinetic energy of the fluid from the bypass valve 20 into static pressure. The diffuser 24 does so by forcing the fluid through a chamber with a decreasing cross-sectional area. The decrease in cross-section increases the fluid's kinetic energy. The fluid then flows into the pressure chamber 17 located near the fluid inlet 16. The increased cross-sectional area of the pressure chamber 17 transfers the kinetic energy of the fluid into static pressure. The pressure chamber 17 eliminates the need for the diffuser 24 to have an additional portion with expanding cross-section to transfer the fluid kinetic energy into static pressure. The pressure chamber 17 additionally eliminates the need for an additional fluid reservoir which is typically present in prior art pumps. The fluid with increased static pressure is mixed in the pressure chamber 17 with fluid from the fluid inlet 16 and flows into the pumping apparatus 14. The increased static pressure of fluid flowing into the pumping apparatus 14 reduces cavitation in the pump and the negative characteristics associated with it.

The fluid inlet 16 and the diffuser 24 are formed as a single element. By forming the fluid inlet 16 and the diffuser 24 into a single piece, the need to machine a separate pump inlet, a separate diffuser chamber, a separate diffuser cap and separate channels for fluid flow present in known bypass-diffuser pumps are eliminated. When this feature is combined with the improvements wherein the need for a diffuser with a widening cross-section and a fluid reservoir are eliminated, the packaging consideration of the pump are further reduced. This combination of improvements allows for a reduction and greater flexibility in the hydraulic fluid pump 10 profile allowing its use in situations where previously unavailable. This reduces the complexity, cost, number of parts, machining requirements and profile of the pump.

The single element fluid inlet 16 and diffuser 24 is formed from a plastic material. This reduces the weight of the pump and further reduces the cost of production. The single element fluid inlet 16 and the diffuser 24 is formed with projecting tabs 26 that lock into recesses in the housing 12. This prevents the need for threading where the single element fluid inlet 16 and the diffuser 24 attach to the housing 12. Elimination of the threading attachment simplifies the manufacturing process and reduces the time and cost of production.

While particular embodiments of the invention have been shown and described, numerous variations and alternate embodiments will occur to those skilled in the art. Accordingly, it is intended that the invention be limited only in terms of the appended claims.

What is claimed is:

1. An hydraulic pump comprising:

a housing;

at least one fluid inlet member, wherein said at least one fluid inlet member contains an inlet intake orifice to accept fluid from a source outside said hydraulic pump and an inlet exhaust orifice to allow fluid to pass out of said at least one fluid inlet member;

at least one fluid outlet for expelling fluid from the pump;

at least one pumping apparatus for transporting fluid from said at least one fluid inlet to said at least one fluid outlet;

at least one bypass valve disposed between said pumping apparatus and said at least one fluid outlet;

at least one diffuser member, wherein said diffuser member has a diffuser member intake orifice to accept fluid from said at least one bypass valve and a diffuser member exhaust orifice to allow fluid to pass out of said at least one diffuser member;

at least one pressure chamber to accept fluid from said diffuser member exhaust orifice and from said fluid inlet exhaust orifice;

wherein said diffuser member exhaust orifice has a smaller cross-sectional area than said diffuser member intake orifice whereby the kinetic energy of fluid passing through said at least one diffuser member is increased;

wherein kinetic energy of the fluid from said at least one diffuser member is transformed into static pressure in said pressure chamber and mixes with fluid from said at least one inlet member; and wherein said at least one inlet member and said at least one diffuser member both feed fluid into said at least one pressure chamber.

2. A hydraulic fluid pump as described in claim 1 wherein said at least one diffuser member and said at least one fluid inlet member are formed as a single element.

3. A hydraulic fluid pump as described in claim 1 wherein said at least one diffuser member and said at least one fluid inlet member are formed of a polymer.

4. A hydraulic fluid pump as described in claim 1 wherein said at least one diffuser member and said at least one fluid inlet member are formed as a single element from a polymer.

5. A hydraulic fluid pump as described in claim 4 wherein said single element contains tabs that lock into a recess in said housing.

6. An hydraulic pump comprising:

a housing;

at least one fluid inlet member, wherein said at least one fluid inlet member contains an inlet intake orifice to accept fluid from a source outside said hydraulic pump and an inlet exhaust orifice to allow fluid to pass out of said at least one fluid inlet member;

at least one fluid outlet for expelling fluid from the pump;

at least one pumping apparatus for transporting fluid from said at least one fluid inlet to said at least one bypass valve disposed between said pumping apparatus and said at least one fluid outlet;

at least one diffuser member, wherein said diffuser member has a diffuser member intake orifice to accept fluid from said at least one bypass valve and a diffuser member exhaust orifice to allow fluid to pass out of said at least one diffuser member;

wherein said diffuser member exhaust orifice has a smaller cross-sectional area than said diffuser member intake orifice whereby the kinetic energy of fluid passing through said at least one diffuser member is increased;

wherein fluid from said diffuser member exhaust orifice and fluid from said inlet exhaust orifice passes into said at least one pumping apparatus; and wherein said at least one pumping apparatus transforms the kinetic energy of the fluid from said at least one diffuser member into static pressure and mixes the fluid with fluid from said at least one inlet member.

7. A hydraulic fluid pump as described in claim 6 wherein said at least one diffuser member and said at least one fluid inlet member are formed as a single element.

8. A hydraulic fluid pump as described in claim 6 wherein said at least one diffuser member and said at least one fluid inlet member are formed of a polymer.

9. A hydraulic fluid pump as described in claim 6 wherein said at least one diffuser member and said at least one fluid inlet member are formed as a single element from a polymer.

10. A hydraulic fluid pump as described in claim 9 wherein said single element contains tabs that lock into a recess in said housing.

* * * * *